US005301531A

United States Patent [19]

Groos

[11] Patent Number: 5,301,531

[45] Date of Patent: Apr. 12, 1994

[54] HORIZONTAL METAL EXTRUSION PRESS

[75] Inventor: Horst Groos, Mettmann, Fed. Rep. of Germany

[73] Assignee: SMS Hasenclever GmbH, Dusseldorf, Fed. Rep. of Germany

[21] Appl. No.: 936,519

[22] Filed: Aug. 28, 1992

[30] Foreign Application Priority Data

Aug. 29, 1991 [DE] Fed. Rep. of Germany ..... 4128677

[51] Int. Cl.[5] ..... B21C 23/02

[52] U.S. Cl. ..... 72/263; 72/255

[58] Field of Search ..... 72/255, 263, 273.5

[56] References Cited

U.S. PATENT DOCUMENTS

| | | | |
|---|---|---|---|
| 3,119,493 | 1/1964 | Zilges . | |
| 4,402,208 | 9/1983 | Sibler | 72/263 |
| 4,416,138 | 11/1983 | Freese et al. | 72/263 |
| 4,856,314 | 8/1989 | Zurru et al. | 72/263 |

FOREIGN PATENT DOCUMENTS

| | | |
|---|---|---|
| 0318631 | 6/1989 | European Pat. Off. . |
| 1020951 | 12/1957 | Fed. Rep. of Germany . |
| 1128827 | 11/1962 | Fed. Rep. of Germany . |
| 2134258 | 1/1973 | Fed. Rep. of Germany . |

OTHER PUBLICATIONS

Horizontal Rod and Tube Extrusion Presses, Schloemann Aktiengesellschaft, Oct. 1966.

Hydraulishche horizontale Strangpressen, von W. Dohrn and H. Schmoll, 1960.

Standard Extrusion Press Aluminum, Schloemann-Siemag AG, Apr. 1981.

Hydraulic Horizontal Extrusion Presses, W. Dohrn and H. Schmoll 1960.

*Primary Examiner*—Lowell A. Larson

*Assistant Examiner*—Thomas C. Schoeffler

*Attorney, Agent, or Firm*—Jacobson, Price, Holman & Stern

[57] ABSTRACT

A horizontal metal extrusion press has a tool cassette (13) for a tool set composed of a die (134), a die holder (32) and at least one pressure ring (36), displaceable horizontally along guide rails (10,11) transversely to the press axis between an extrusion position (P) on the press axis and a changing position (W) spaced horizontally from the press axis, and replaceable by a second cassette in the changing position. The cassette has an upwardly open U shape to receive the tool set. A locking piece (14) for retaining the tool set can move in a vertical guideway (22) in the upper guide rail (10), to an upper position above the opening of the cassette and to a lower position inside the opening for closing the opening. The cassette opening has an internal bead (29), and the die holder has a corresponding annular groove. The locking piece is guided on the beads along the sides of the cassette opening.

8 Claims, 4 Drawing Sheets

HORIZONTAL METAL EXTRUSION PRESS

BACKGROUND OF THE INVENTION

A horizontal metal extrusion press consists of a press cylinder crosshead, a counter crosshead or platen, tie rods connecting these, a moving crosshead with a press ram, and a receiver for the billet to be extruded, the moving crosshead and the billet receiver being movable along the press axis, and the die which forms the extrusion being inserted in a die holder and being supported on the counter platen via a pressure ring or pressure rings. Great importance is attached to the design of the carrier for the tool set, composed of the die, the die holder and the pressure ring(s), since this has a decisive influence on the service life of the dies, the product quality, the die changing times, the operational reliability and the structure of the metal extrusion press. An important distinctive feature of metal extrusion presses is therefore the design of the tool carriers as slides or rotary heads. So that a change of dies can be prepared or a die can be treated (reconditioning, cleaning, lubricating, cooling, preheating) whilst another die is in use, the slides and the rotary heads are provided with two receivers which can be brought alternately into the working position (company specification P2/317 "Horizontal Rod and Tube Extrusion Presses", Schloemann Aktiengesellschaft, of October 1966; Zeitschrift for Metallkunde 51st year, (1960) no. 1, p. 29–35, "Hydraulische horizontale Strangpressen" von W. Dohrn and H. Schmoll).

Tool slides have the disadvantage that a change or treatment of dies must be carried out alternately on each side of the press. Rotary tool heads have a high spatial requirement resulting from their swivelling circle, and their structural complexity of rotary tool heads is a disadvantage; these disadvantages are compounded by the fact that they require a locking mechanism for the rotary arm when it is in the working position, which locking mechanism supports the rotary arm against axial forces occurring when the receiver is pulled off the shearing tool head and against radial shearing forces. Because of these disadvantages of rotary tool heads, it is preferable to use tool slides, particularly in the modified form of cassette slides in conjunction with a quick changing device for the cassettes, since these allow very short changing times whilst retaining a simple structure and the change is only carried out on one side of the press. In order to receive the tools, the cassettes are provided with a U-shaped opening at the top and are displaceable in a horizontally transversely to the axis of the press between a an extrusion position and a changing position, and to this end the counter platen of the press is provided with a guide frame, comprising an upper and a lower guide rail, on its side facing the press cylinder crosshead. A piston-cylinder unit is connected to the guide frame as a displacement drive for the cassettes, which can be replaced in the changing position by means of a second guide directed transversely to the first guide (EP 0 318 631 A2; firm specification P2/3210 "Standard extrusion press for aluminium", Schloemann-Siemag AG, of April 1981).

In order to secure a die holder axially in a tool carrier (slide, rotary head or cassette), the external diameter of the die holder is increased towards the counter holder by a step, the annular surface of the step being formed by a shoulder, a collar or an annular groove, and the tool carriers are shouldered correspondingly, the corresponding shoulder, the groove corresponding to the collar of the die holder or the bead corresponding to the annular groove of the die holder continuing on the U arms of the tool carrier opening. If, at the end of the extrusion process, the extrusion residue is severed by a shearing blade moved along the front surface of the die and the die holder, the die and the die holder can be lifted in the tool carrier when the shearing blade is moved back, which should not be possible. In order to prevent this, tool slides are closed with locking pieces, which need to be removed and reinserted whenever the die and the die holder are replaced (DE-AS 1 020 951). When using tool slides with two receivers for dies which can be brought alternately into the working position, the change of dies is simplified by a locking bar which is movable to a limited extent in the tool slide between limit stops and closes the tops of the openings for the tool sets in the respective extrusion position (DE-OS 21 34 258).

Before the extrusion residue can be sheared off, the receiver needs to be displaced so that the extrusion residue is exposed. A considerable axial force occurs when the receiver is "stripped off" in this manner, and a tilting moment occurs on the die holder when the extrusion residue is sheared off. Since, on the corresponding surfaces of the die holder and the tool carrier, the die holder is supported only slightly more than in its lower half, eccentric transmission of forces occurring when the receiver is torn off and the tilting moment occurring when the extrusion residue is sheared off lead to high localized surface pressure in the region where the die holder's periphery changes from being supported to being unsupported, with the result that these surfaces are deformed and it is not possible to guarantee the desired seating of the tools in the tool carrier to eliminate tilting. However, a tilting of the tools has the result that shearing off the extrusion residue does not produce a clean cut which is plane-parallel to the front surface of the die and the die holder. Projecting material residues, which can build up during successive extrusion processes, finally prevent the billet receiver from resting against the die holder in a sealing manner. In dies with an antechamber, an unclean cut can lead to air pockets, thus making it difficult to carry out billet-to-billet extrusion and to separate a narrow piece of extrusion containing the weld.

The known locking pieces or locking bars are not suitable for improving the support of the tools in the tool carrier so that tilting can be excluded, since to achieve this the support would need to be designed so as to be free from play and have sufficient dimensions. A locking piece according to DE-AS 1 020 951 can only be inserted and taken out again easily if it is designed with plenty of play. A locking bar according to DE-OS 21 34 258 gives an insufficient supporting surface.

BRIEF SUMMARY OF THE INVENTION

The invention relates to a metal extrusion press with a tool carrier formed as a cassette slide, and it is the object of the invention to achieve a complete support of the tool set via the die holder, practically without play, so that it is protected against the axial force occurring when the receiver is "stripped off" and the tipping moment occurring when the extrusion residue is sheared off, using means which do not complicate the changing of the tool.

In order to achieve this object, the invention provides a locking piece which can be moved by a drive perpendicular to the press axis in a guideway located in the upper guide rail of the guide frame for the cassettes and which, in the upper position, is located outside the opening of a cassette and, in its lower position, is located inside the opening of a cassette in the extrusion position, thus closing the opening. The displacement drive makes it possible to engage the locking piece—which is positioned by its guideway exactly over the opening of a cassette in the extrusion position—so as to lock the tools in the cassette practically without play, and then to disengage it again, this engagement optionally being facilitated by edge mountings on the surfaces of the locking bar. Regarding the state of the art, it should be mentioned that, in metal extrusion presses with a tool carrier formed as rotary tool head, it is known to arrest the rotary arm of the rotary tool head in the working position by a fork-shaped locking bar which is placed radially thereover and whose arms engage over the rotary tool arm securing it against rotation and displacement. With the central part of its for, the locking bar is placed in front of a projection of the die holder which thereby receives additional support (U.S. Pat. No. 3,119,493 corresponding to DE-PS 1 128 827). A corresponding locking bar is neither suitable nor necessary for arresting the cassette of a cassette slide in its guide frame.

In the case of a cassette provided with a bead which corresponds to an annular groove on the die holder, engages in the lower half of the annular groove and continues on the U arms of the cassette opening, the locking piece is—as a further development of the invention—provided with lateral grooves in order to guide it on the bead parts extending along the U arms of the cassette opening, and with a collar by means of which the locking piece engages in the upper half of the annular groove on the die holder and fills this half of the annular groove between the bead in the cassette opening, in such a manner that the center of gravity center of the supporting surface of the die holder on the locking bar is more or less the same as the center of gravity center of the guide surfaces of the locking piece.

It is possible to achieve a space-saving arrangement of the locking piece with the guides and drive and the shears with the drive for severing the extrusion residue, if two piston-cylinder units are provided for moving the locking piece, the track of the blade carrier of the shears being arranged between these piston-cylinder units.

BRIEF DESCRIPTION OF THE DRAWINGS

An embodiment of the invention will now be described in detail with reference to the accompanying drawings wherein:

FIGS. 3*a*, 3*b* and 3*c* are cross-sectional views showing details of FIG. 1 on an enlarged scale, taken in the vertical central plane of the extrusion pres along the line III—III marked in FIG. 2, for different operational situations wherein:

FIG. 3*a* shows the extrusion press with the cassette and tool set engaged in the extrusion position, but with the mechanism for locking the tool set still disengaged.

FIG. 3*b* shows the same position, but with the locking mechanism engaged—in this position an extrusion is extruded —and FIG. 3*c* shows the situation after the extrusion has been extruded, with the "stripped off" billet receiver offset from the tool set and after the extrusion residue has been severed.

DESCRIPTION OF PREFERRED EMBODIMENTS

Figure 1:
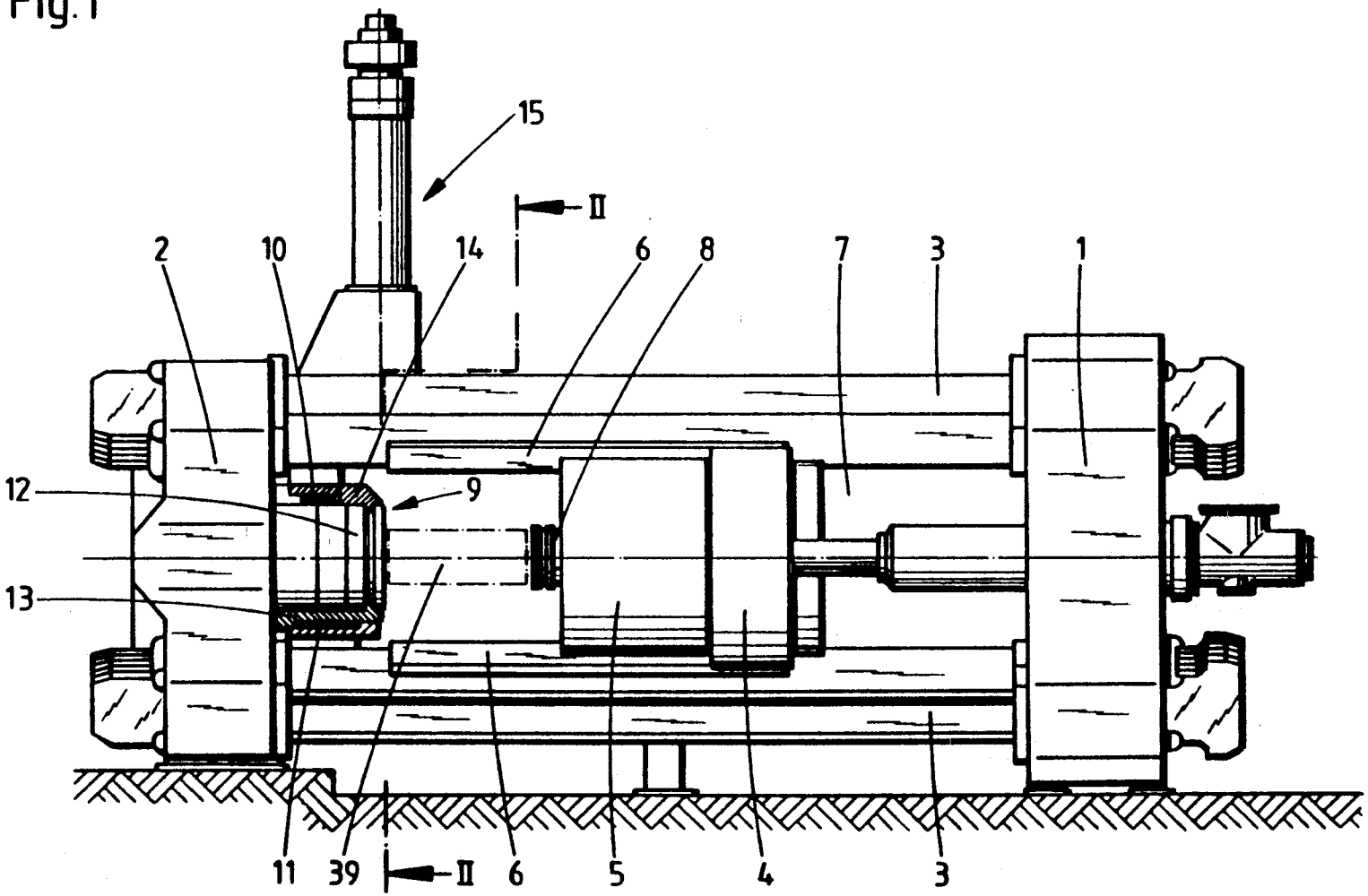
FIG. 1 is a side elevational view of the entire extrusion press of the invention.

As shown in FIG. 1, the extrusion press consists of an extrusion cylinder crosshead 1, a counter platen 2 and tie rods 3 connecting the cylinder crosshead 1 and the counter platen 2. A moving crosshead 4 and a billet receiver 5 can be moved along the press axis, being arranged so as to slide along guideways 6. The moving crosshead 4, moved by an extrusion piston which can be activated in the cylinder 7, is provided with an extrusion ram 8. A guide frame 9, comprising an upper guide rail 10 and a lower guide rail 11, is attached to the counter platen 2, the cassette 13 carrying the tool set 12 required in each case being guided movably in this guide frame 9 in a horizontal manner transversely to the press axis. A locking piece 14 can be engaged in the cassette 13 in the extrusion position and the tool set 12 is thus locked in the cassette 13. A shearing device 15 is provided in order to sever an extrusion residue at the end of the extrusion process.

Figure 2:
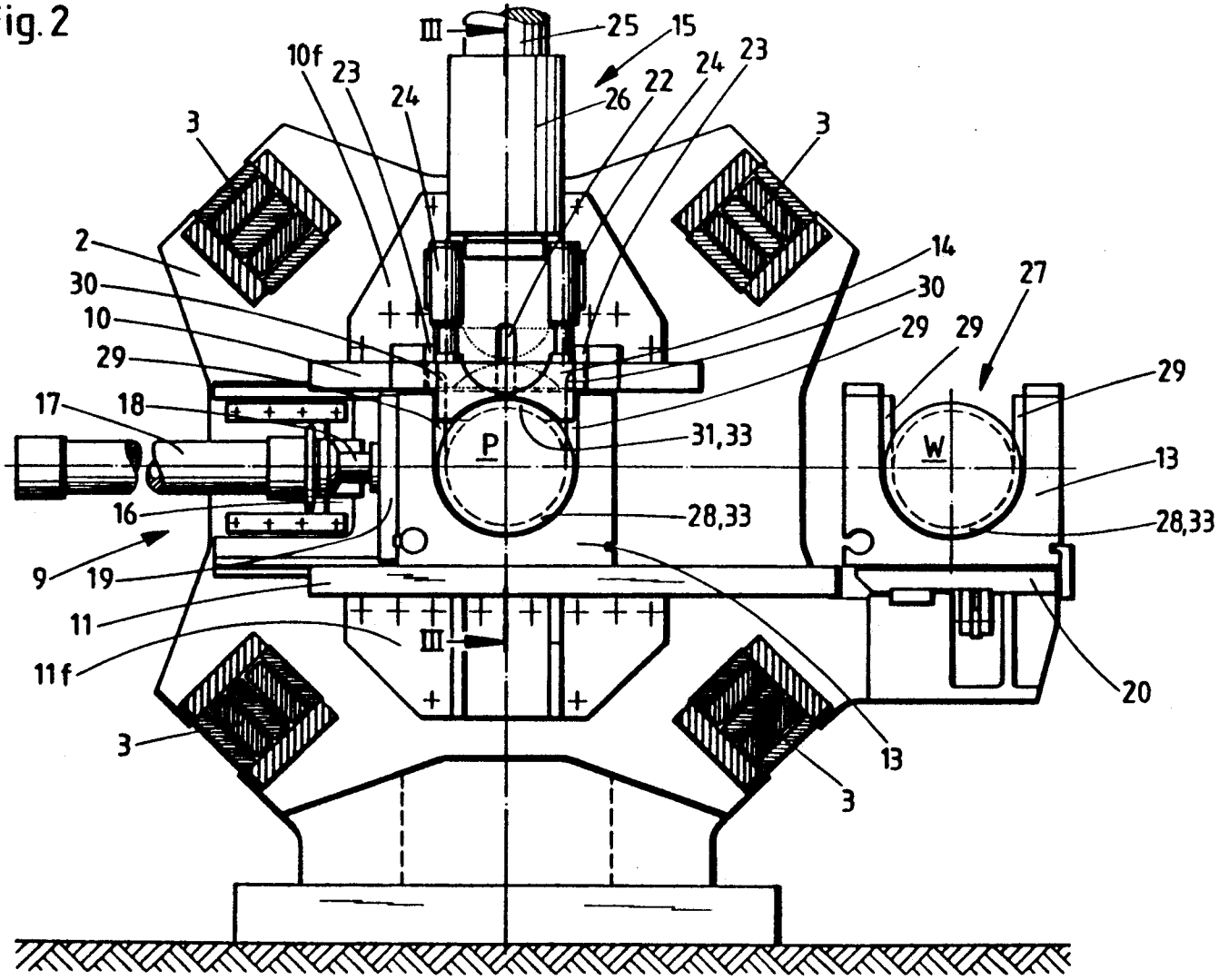
FIG. 2 is a cross-sectional view taken along the section line II—II marked in FIG. 1, on an enlarged scale.

As can be seen from FIG. 2 in particular, the upper guide rail 10 and the lower guide rail 11 form the guide frame 9 for the cassettes 13, which can be displaced between an extrusion position P and a changing position W. The guide rails 10 and 11 are provided with flanges 10f and 11f respectively connected to the counter platen 2. A bridge piece 16 between the guide rails 10 and 11 carries a piston-cylinder unit 17, whose piston rod 18 is provided with a head piece 19 with which one of the cassettes 13 can be coupled, and which can therefore be displaced by the piston-cylinder unit 17 between the extrusion position P and the changing position W. A sliding table 20 is arranged as an extension of the guide rail 11, this sliding table 20 being transportable transversely to the guide rail 11 and being capable of receiving two cassettes 13. In order to change the tool, the cassette 13 with the tool set 12 which is to be brought out is slid out of the extrusion position P from the press axis and into the changing position W on the sliding table 20, a cassette 13 with the tool set 12 which is to be brought in already being ready on the second receiver of this sliding table 20, which cassette 13 is now brought into line with the guide rails 10 and by means of the sliding table 20 and is brought into the extrusion position P by means of the piston-cylinder unit 17.

Figure 3B:
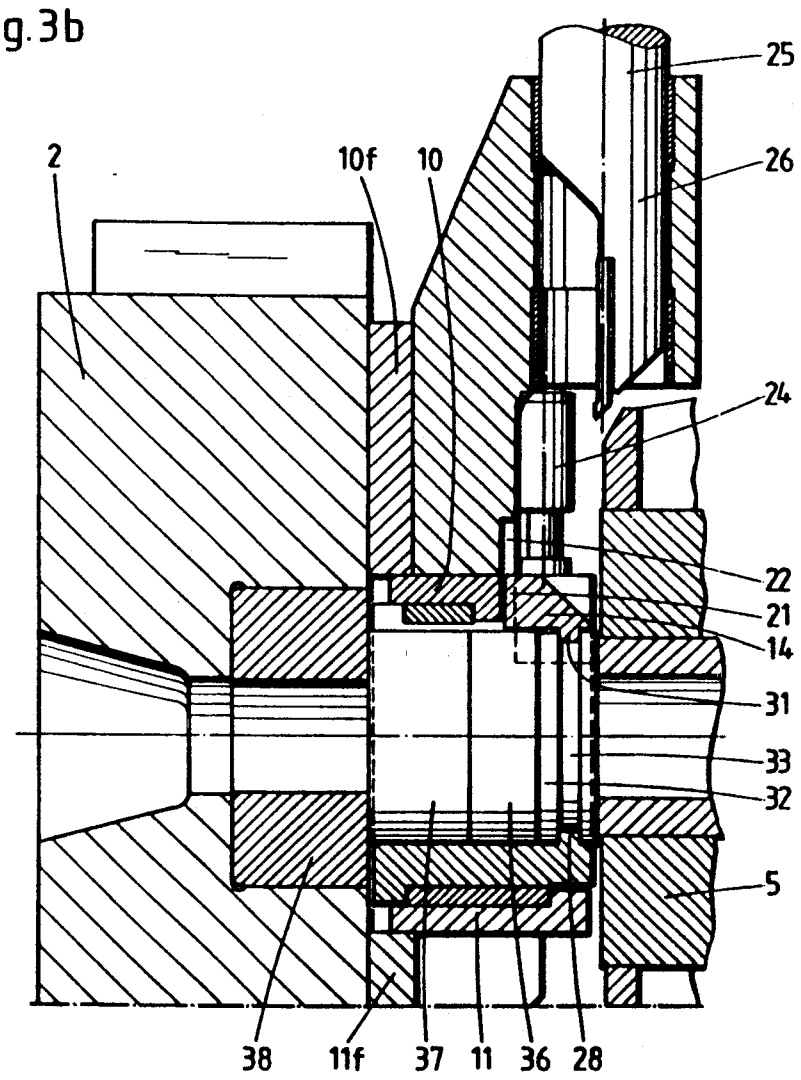
Figure 3A:
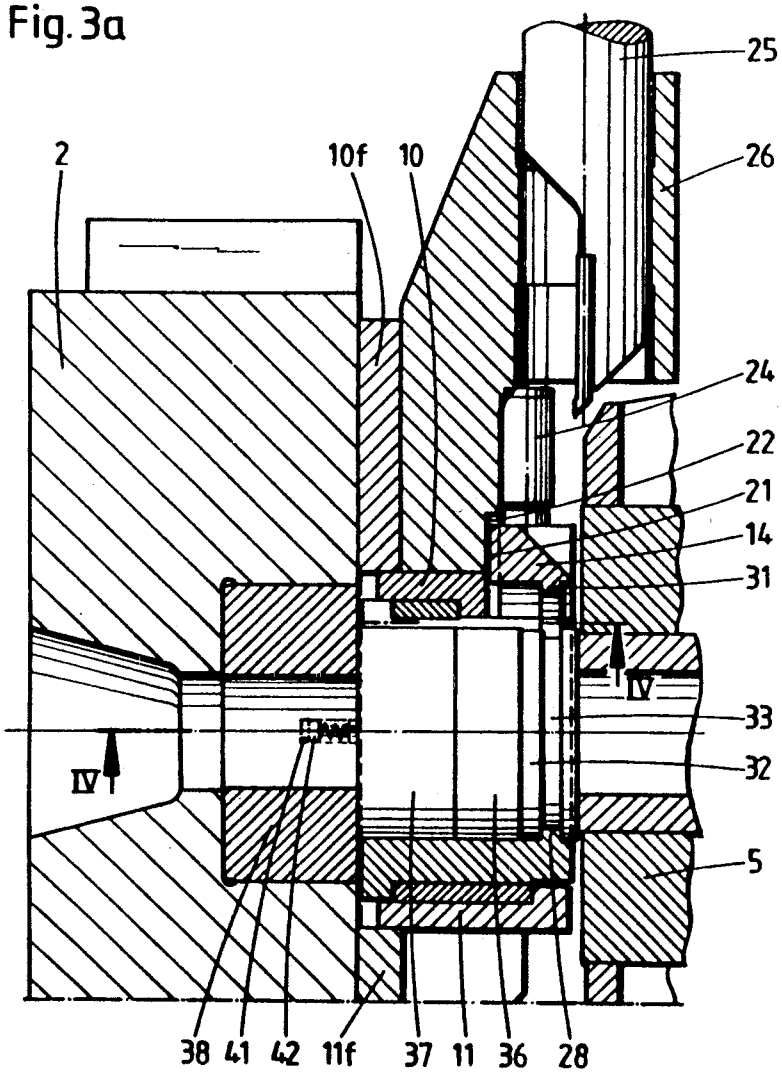
Figure 3C:
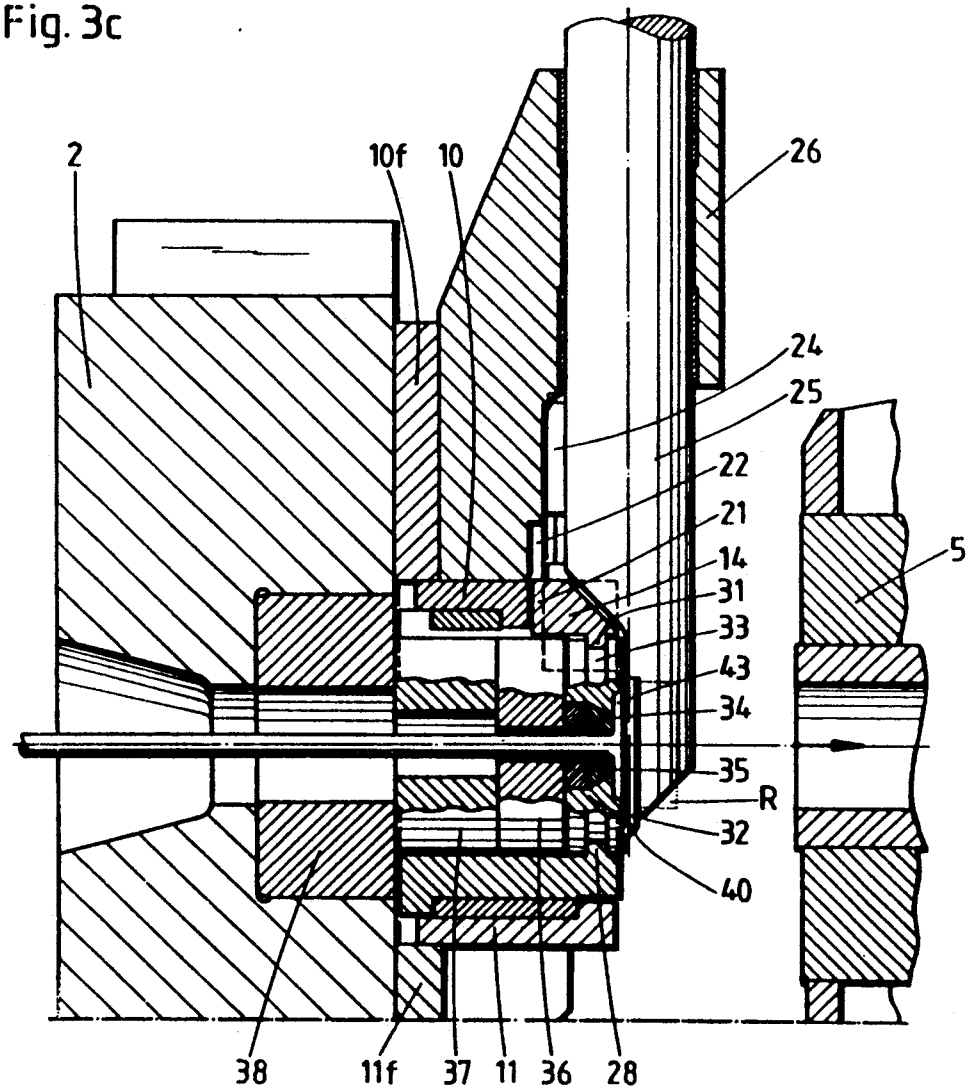

Whilst the cassettes 13 with the tool sets 12 are being changed, the locking piece 14 is disengaged, as shown in FIG. 2 by dotted lines and in FIG. 3*a*. The locking piece 14 is engaged in order to lock a tool set 12 in the cassette 13 in the extrusion position P. The locking piece 14 is guided in a groove 22 by means of a guide rib 21 and held at the sides by cover plates 23. In order to engage and disengage the locking piece 14, two piston-cylinder units 24 are arranged at the sides outside the range of movement of the ram 25 of the shearing device 15 and, together with the blade ram guide 26 of the shearing device 15, these piston-cylinder units 24 are attached to the counter crosshead 2 via the flange 10f of the upper guide rail 10. The cassettes 13 have a U-shaped opening 27 at the top, a bead 28 extending along the lower curve of the opening 27 and continuing along the U arms of the opening 27. The locking piece 14, which can be engaged in the cassettes 13, is provided with lateral grooves 30 which, when the locking piece 14 is engaged, receive the bead parts 29 extending along the U arms of the opening 27 of a cassette 13 and thus guide the locking piece 14 in the cassette 13. Moreover, the locking piece 14 is provided with a collar 31. Together with the bead 28 in the opening 27 of a cassette 13, the collar 31 secures a die holder 32 which has been inserted in the cassette 13 and which is provided with an annular groove 33 for this purpose. The die holder 32 encloses a die 34 and a supporting ring 35 (see FIG. 3*c*) and, together with a pressure ring 36 and—as in the embodiment—where necessary a second pressure ring 37, forms a tool set 12 which is supported on the counter platen 2 on a pressure piece 38 inserted therein against the bearing pressure of the billet receiver 5 and against the pressure occurring during extrusion.

Figure 4:
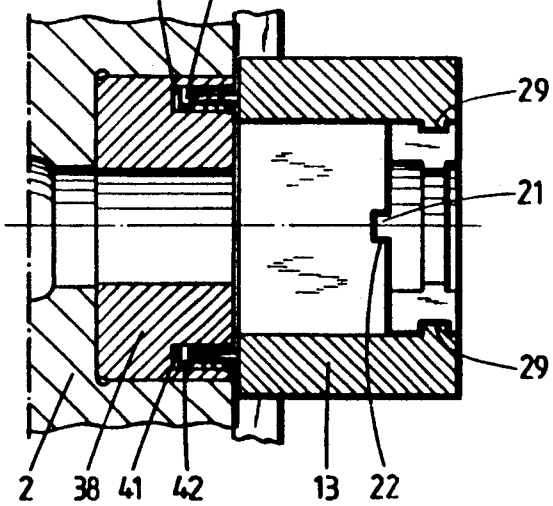
FIG. 4 is a further detail, showing a cross section in the horizontal central plane of the extrusion press taken along the line IV—IV marked in FIG. 3*a*.

In FIG. 1, the extrusion press is shown in the operational situation where a billet 39 which is to be extruded is loaded, to which end the billet receiver 5 is fed over the press ram 8 with its shifting device (not shown). The billet receiver 5 is now moved towards the counter platen 2 and, in doing so receives the billet 39 and comes to rest against die holder 32 in the extrusion position P. As the tool set 12 is pressed against the counter platen 2, this cancels out the play which is necessary in order to bring a cassette 13 with a tool set 12 between the pressure ring 37 located right at the front and the counter platen 2 with the pressure piece 38, and the pressure builds up between these elements which seals the billet receiver 5 in relation to the die holder 32. At the same time, the locking piece 14 is engaged by means of the piston-cylinder units 24 and is then in the position shown in FIGS. 2, 3*b* and 3*c*. After a billet 39 has been extruded (operational situation in accordance with FIG. 3*b*), the billet receiver 5 is offset (stripped off) from the die holder 32, and the extrusion residue R, as shown by dotted lines in FIG. 3*c*, remains on the front side of the die 34 and the die holder 32. The extrusion residue R is severed by means of the shearing device 15, to which end the ram 25 is provided with a shearing blade 40. The shearing blade 40 can be arranged at a certain distance from the front surface of the counter platen 2 with the pressure piece 38, which necessitates a closely toleranced axial dimension of the tool set 12, consisting of the die holder 32 and die 34, the supporting ring 35 and the pressure rings 36 and 37, the chewing pressure being absorbed by the counter platen 2 with the pressure piece 38. In order to ensure that the tool set 12 rests against the counter platen 2 with the pressure piece 38 after the receiver has been "stripped off" in order to shear off the extrusion residue R, it is possible to provide a pressure device (not shown) arranged between the guide rails 10 and 11 and the cassette 13 carrying the tool set 12. The dimensional accuracy of the tool set 12 is not required to be particularly high if the cassette 13 with the tool set 12 is aligned onto the guide rails 10 and 11, to which end pressure devices are provided. In the embodiment shown, these pressure devices are the pistons 42, which can be activated with pressure medium, are situated in cylinder bores 41 in the pressure piece 38, and act on the cassette 13 with force exceeding the chewing pressure of the shearing process (see FIG. 3*a* and FIG. 4).

The high precision of the cut which can be achieved when severing the extrusion residue R is of particular advantage in "billet-to-billet extrusion" with an antechamber 43 preceding the die 34 (shown in FIG. 3*c*), a smooth clean cutting surface being a prerequisite for extrusion without air pockets.

I claim:

1. A horizontal metal extrusion press having a horizontal press axis, and comprising:

an extrusion cylinder crosshead disposed along said press axis;

a counter platen having a side facing said extrusion cylinder crosshead;

tie rods inter-connecting said extrusion cylinder crosshead and said counter platen;

a moving crosshead movable along said press axis;

an extrusion ram on said moving crosshead;

a billet receiver for a billet to be extruded movable along said press axis;

a guide frame on said side of said counter platen comprising an upper guide rail and a lower guide rail extending horizontally transversely to said press axis;

a tool set comprised of a die, a die holder and at least one pressure ring;

a cassette adapted to support said tool set and being displaceable horizontally along said guide rails transversely to said press axis between an extrusion position on said press axis and a changing position spaced horizontally from said press axis;

first drive means mounted on said guide frame for displacing said cassette between said extrusion and changing positions, said cassette being replaceable by a second cassette in said changing position;

each cassette having a substantially U-shape with upwardly extending arms and an upwardly facing opening and adapted to receive said tool set;

a locking member removably insertable into said cassette opening for retaining said tool set therein;

an upwardly extending guideway in said upper guide rail of said guide frame, said locking member being engageable with and movable along said upwardly extending guideway perpendicular to said press axis between an upper position located outside said cassette opening and a lower position located inside said cassette opening in the extrusion position of said cassette for closing said opening, said locking member being supported substantially radially in said cassette opening;

second drive means for moving said locking member along said guide means between said upper and lower positions; and engaging surface means on said locking member and said cassette for axially supporting said die holder in said cassette, complementary to axial support by said cassette.

2. The extrusion press as claimed in claim 1, and further comprising:

an annular groove on said die holder;

a corresponding bead on said cassette for engagement in the lower half of said annular groove in use and extending upwardly on said arms of said cassette;

a collar on said locking member engageable in the upper half of said annular groove when said locking member is in said lower position; and said locking member being guided on said beads along said arms of said cassette.

3. An extrusion press as claimed in claim 2 and further comprising:

a blade carrier mounted for relative movement with respect to said die holder;

a blade on said blade carrier for shearing off an extrusion residue; and wherein said second drive means comprises two piston-cylinder units disposed outside of the path of movement of said blade carrier.

4. An extrusion press as claimed in claim 3 wherein:

said locking member is movable vertically in a groove; and further comprising overlapping cover plates for holding said locking member and rib means for locating for said locking member.

5. An extrusion press as claimed in claim 2 wherein:

said locking member is movable vertically in a groove; and further comprising overlapping cover plates for holding said locking member and rib means for locating for said locking member.

6. An extrusion press as claimed in claim 1 and further comprising:

a blade carrier mounted for relative movement with respect to said die holder;

a blade on said blade carrier for shearing off an extrusion residue; and wherein said second drive means comprises two piston-cylinder units disposed outside of the path of movement of said blade carrier.

7. An extrusion press as claimed in claim 6 wherein:

said locking member is movable vertically in a groove;

and further comprising overlapping cover plates for holding said locking member and rib means for locating for said locking member.

8. An extrusion press as claimed in claim 1 wherein:

said locking member is movable vertically in a groove; and further comprising overlapping cover plates for holding said locking member and rib means for locating for said locking member.

* * * * *